US009114641B2

(12) United States Patent
Kerpe

(10) Patent No.: US 9,114,641 B2
(45) Date of Patent: Aug. 25, 2015

(54) APPARATUS FOR IMPRINTING A MATERIAL WEB

(75) Inventor: Sven Kerpe, Eggenstein-Leopoldshafen (DE)

(73) Assignee: Markem-Image CSAT GmbH, Eggenstein (DE)

( * ) Notice: Subject to any disclaimer, the term of this patent is extended or adjusted under 35 U.S.C. 154(b) by 349 days.

(21) Appl. No.: 13/373,337

(22) Filed: Nov. 12, 2011

(65) Prior Publication Data

US 2012/0060709 A1 Mar. 15, 2012

Related U.S. Application Data

(63) Continuation-in-part of application No. PCT/DE2010/000423, filed on Apr. 29, 2010.

(30) Foreign Application Priority Data

May 13, 2009 (DE) ..... 10 2009 021 176

(51) Int. Cl.

| | |
|---|---|
| ***B65H 20/34*** | (2006.01) |
| ***B41F 13/04*** | (2006.01) |
| ***B41J 15/00*** | (2006.01) |
| ***B41J 15/16*** | (2006.01) |
| ***B65H 20/24*** | (2006.01) |

(52) U.S. Cl.

CPC ..... *B41J 15/005* (2013.01); *B41J 15/165* (2013.01); *B65H 20/24* (2013.01); *B65H 2301/4491* (2013.01); *B65H 2801/12* (2013.01)

(58) Field of Classification Search

USPC ..... 101/178

See application file for complete search history.

(56) References Cited

U.S. PATENT DOCUMENTS

| | | | | |
|---|---|---|---|---|
| 2,140,834 | A * | 12/1938 | Gazette | 101/228 |
| 3,049,078 | A * | 8/1962 | Smith, Jr. | 101/228 |
| 3,563,174 | A * | 2/1971 | Anderson et al. | 101/225 |
| 4,182,473 | A | 1/1980 | Mikulas | |
| 4,356,765 | A * | 11/1982 | Houseman et al. | 101/228 |
| 4,592,278 | A | 6/1986 | Tokuno | |
| 5,585,879 | A * | 12/1996 | Tahara et al. | 396/570 |
| 5,611,272 | A * | 3/1997 | Steuer | 101/23 |
| 5,729,817 | A * | 3/1998 | Raymond et al. | 399/384 |
| 6,052,144 | A | 4/2000 | Reyner | |
| 6,230,616 | B1 * | 5/2001 | Steuer | 101/23 |
| 6,340,215 | B1 | 1/2002 | Yamakita | |
| 6,799,507 | B2 * | 10/2004 | Ohba et al. | 101/228 |

(Continued)

FOREIGN PATENT DOCUMENTS

| | | |
|---|---|---|
| CH | 610 817 | 5/1979 |
| CH | 610817 A5 | 5/1979 |
| CN | 1422745 A | 6/2003 |

(Continued)

*Primary Examiner* — Jill Culler

(74) *Attorney, Agent, or Firm* — Fish & Richardson P.C.

(57) ABSTRACT

In an apparatus for imprinting a material web including a transport arrangement for moving the material web through the apparatus along stations for applying coloring agents to the material web and fixing the coloring agent applied to the web, and a web buffer arranged in the web transport direction of the material web ahead of the first imprinting station for accommodating a section of the material web moved back out of the station area upon shutdown of the apparatus, at least one clamping structure (11*a*, 11*b*) is provided for fixing the material web (3) during the movement of the material web back out of the station area.

4 Claims, 1 Drawing Sheet

(56) References Cited

U.S. PATENT DOCUMENTS

| | | | | |
|---|---|---|---|---|
| 6,820,549 | B2 * | 11/2004 | Iyokawa et al. | 101/228 |
| 2004/0177779 | A1 * | 9/2004 | Steffen et al. | 101/228 |

FOREIGN PATENT DOCUMENTS

| | | | |
|---|---|---|---|
| DE | 19535535 | A1 | 3/1997 |
| EP | 0962326 | B1 | 5/2003 |

* cited by examiner

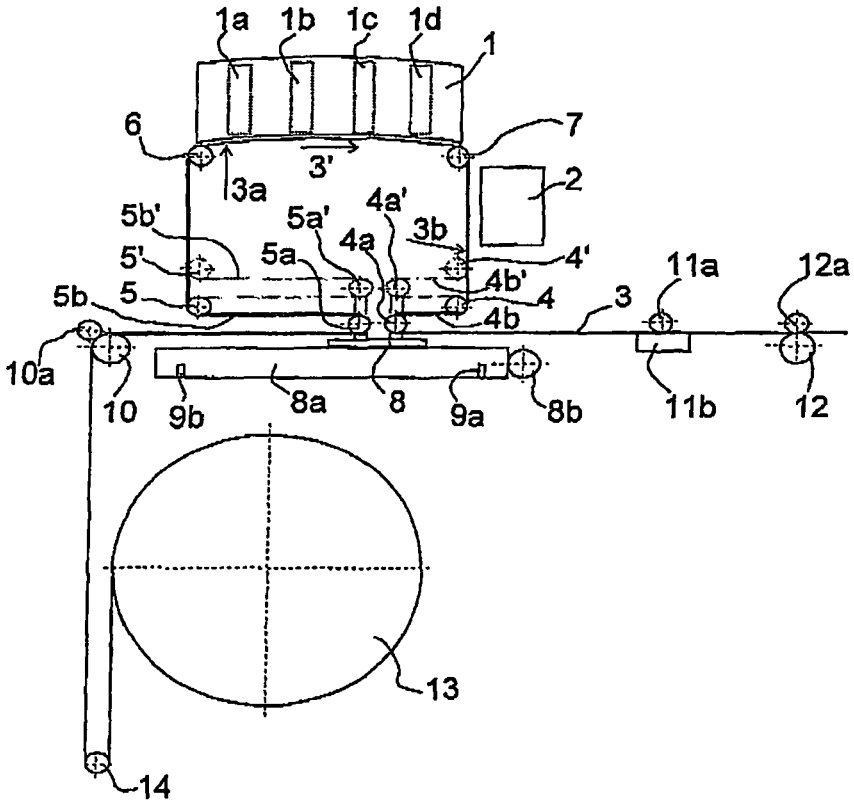
1a
1b
1c
1d
1
6
7
3'
3a
2
5b'
5a'
4a'
3b
5'
5a
4a
4'
4b'
11a
12a
5b
5
4
3
4b
10a
10
9b
8a
8
9a
8b
11b
12
13
14

APPARATUS FOR IMPRINTING A MATERIAL WEB

This is a Continuation-In-Part application of pending international patent application PCT/DE2010/000423 filed Apr. 29, 2010 and claiming the priority of German patent application 10 2009 021 176.4 filed May 13, 2009.

BACKGROUND OF THE INVENTION

The invention relates to an apparatus for imprinting a material web which is movable through the apparatus by a transport device and to which at least in a first station, a coloring agent is applied and, in a second station, an additional coloring agent is applied to the material web and/or the coloring agent is fixed to the material web.

Such an apparatus is conventional and is manufactured and offered for example by the company CSAT Gesellschaft für Computersysteme and Automatisierungs-Technik. With this known apparatus for example an aluminum foil which is taken from a foil roll can be color imprinted. To this end, the apparatus includes printing heads which are arranged in the transport direction of the foil one after the other, each applying a different coloring agent to the foil. In context with the present application, a black ink or a black toner is also considered to be a coloring agent.

Each of the printing heads produces on the foil a partial image corresponding to its coloring agent. The partial images produced by the printing heads are superimposed so that, after the last printing head, an overall color image is provided composed of the partial color images of the printing heads.

In transport direction of the foil after the printing heads, there is a fixing unit by means of which the images generated on the foil can be fixed. For forming a complete picture on the foil, the foil consequently, has to move along a predetermined path through the printing apparatus. The distance the foil needs to travel for generating a completely finished image corresponds to the length of the foil from the beginning of the first printing head to the end of the fixing unit.

Upon terminating the printing operation, it is therefore necessary that the last started image is moved through the printing apparatus until it has passed the fixing device. Since, at this point in time, there is below the printing heads an area of the foil to which no coloring agent was applied by the printing heads in the printing apparatus, after completion of the last image in the fixing unit, the foil needs to be moved back by the corresponding distance in a direction opposite to the travel direction. In this way, it is avoided that the foil has an imprinted area when operation of the printing apparatus is resumed.

Since the image generated on the foil consists of several partial images of different colors arranged on top of one another, it is necessary that the foil is moved through the printing apparatus with very high precision that is it needs to be moved past the printing heads in a highly precise manner. The smallest displacement of the foil would have the result that the individual partial images are not congruent on the foil whereby the contours of the final image would be blurred.

However, during the backward movement of the foil after completion of the last partial image, the foil is often slightly displaced, in particular sidewardly transverse to the direction of movement, which results in a position displacement of the foil. Only during printing operation, the foil re-assumes its correct position. That is the foil changes its position—starting from the incorrect position it assumed during shutdown of the apparatus—continuously up to the point where it is again in its correct position. The images generated during this period on the foil have therefore an inferior quality.

It is the object of the present invention to provide a printing apparatus of the type described above wherein however the quality loss of the images generated during start-up of the printing apparatus is very small or even negligible.

SUMMARY OF THE INVENTION

In an apparatus for imprinting a material web including a transport arrangement for moving the material web through the apparatus along stations for applying coloring agents to the material web and fixing the coloring agent applied to the web, a web buffer device is arranged in the web transport direction of the material web ahead of the first imprinting station for accommodating a section of the material web moved back out of the station area upon shutdown of the apparatus.

Since, in the transport direction of the material web ahead of the first station, a buffer device is arranged, it can be avoided that the material web is altogether moved backward upon shut-down of the printing apparatus. In particular does not need to be moved backwardly ahead of the first station, that is, it does not to be rewound onto the material roll from which it is taken during normal operation. Rather the section of the material web moved back from the printing apparatus is taken up by the buffer so that the web material ahead of the buffer is not moved during the return movement. As a result, the material web ahead of the buffer remains fixed in its accurate position. This has an advantageous effect on the quality of the images generated after printing operation is resumed.

It is advantageous to provide, in the transport direction of the material web after the fixing station, a second buffer. In this way, the material web in the printing apparatus does not need to pull the whole web section back during the backward movement of the web material disposed in the printing apparatus. The backward movement of the unimprinted material section in the printing apparatus is then accommodated by the material disposed in the second buffer from which sufficient material can be retracted as is required for the backward movement of the material web in the printing apparatus. As a result, the movement of the web material disposed after the second buffer is uncoupled from the movement of the web material section already disposed downstream of the second buffer. The second buffer is selected so as to be capable of accommodating, during shut down of the printing apparatus, at least a web material length as required for the completion of the last image whose printing has already started. With the two buffers, the movement of the material web in the transport direction of the material web ahead of the first buffer as well as the material web after the second buffer is decoupled from the movement of the material web between the first and second buffers.

When the material web part present in the apparatus is moved back into the first buffer, a corresponding length of the material web is moved out of the second buffer. Since the number of components needed to achieve this is limited these components can be manufactured very precisely at reasonable costs. With a precise design of the buffers, it can be ensured that during the transport of the foil from the second to the first buffer, it is not displaced sidewardly.

Expediently, the second buffer is connected to the first buffer in a positively controlled manner. The arrangement provides for a uniform pulling force on the foil in the transport direction during the movement from one buffer to another. This feature has an advantageous effect on the position accuracy of the foil. A "positive control" is intended to mean that one buffer always releases or, respectively takes up as much material web as the other takes up or, respectively, releases. The positive control can be realized mechanically or electronically.

In a particular embodiment of the invention, at least one buffer includes a storage roller, but preferably both buffers include a storage roller around which the material web extends like around a compensating roller. Such a buffer storage device is easy to manufacture and can be precisely constructed so that, during movement into or out of a buffer, the material web is essentially not subjected to any sideward displacement. A particularly high precision can be achieved in that the storage roller is not elastic that is it does not have an elastic surface. Advantageously, the storage rollers consist of a metal.

In connection with the last-mentioned embodiment, it is particularly advantageous if the storage rollers are arranged on a carriage. In this way, movement of the storage rollers can be controlled in a simple manner for the transfer of material web from one buffer to the other. Furthermore, if the storage rollers are supported on a common carriage, the second buffer is fixedly connected to the first buffer so that both storage rollers execute the same movement. As a result, one buffer releases exactly the same amount of web material as is taken up by the other buffer.

It is very advantageous if the storage rollers are so arranged that both legs, but in any case, at least one leg of the loop formed by the first storage roller is disposed in, or parallel to a plane in which also the respective legs or leg of the loop formed by the second storage roller are, or is, disposed. In other words, the storage rollers are so arranged that the respective sections of the material web which are disposed in the buffers extend along a single line or two parallel lines. That is, the respective sections of the material web do not move during the movement of the storage rollers in the direction normal to the material web.

With the above-described arrangement of the storage rollers, it is to be achieved that the two legs of the loop extend parallel to each other. In accordance therewith the elements must be arranged, around which the ends of the material web remote from the base of the loop are redirected. Considering however that, with material webs of different thickness, the arrangement of the storage rollers would have to be changed, a slight deviation from an exactly parallel arrangement of the loop legs may be tolerated.

In a further embodiment of the invention, sensors are provided for detecting the end positions of the carriage. The sensors are preferably inductive or capacitive sensors and permit an adjustment of the travel distance of the carriage. The sensors are therefore advantageously adjustable in the directions of movement of the carriage.

In another advantageous embodiment of the invention, a clamping arrangement is provided for fixing the material web. With the clamping arrangement, which is preferably disposed between the additional station and a take-up roller for the imprinted material web, the material web can be fixed in transport direction after the second buffer when the material web is transferred from the second buffer to the first buffer and vice versa.

Preferably, a tensioning arrangement is disposed ahead of the first station by which the material web can be held under tension at least in the area of the first station and the additional station. Instead or additionally a clamping arrangement may also be provided ahead of the first station. In this way, the material web part disposed in the apparatus or respectively in the buffers can be uncoupled from rest of the material web.

In another particular embodiment of the invention, the material web can be taken off a supply roll only against a certain force. In this way, it is achieved in a simple manner that in the transport direction the material web is maintained under constant tension.

Additional particulars, features and advantages of the invention will become more readily apparent from the following description of a particular embodiment with reference to the accompanying drawings.

BRIEF DESCRIPTION OF THE DRAWINGS

The sole FIGURE shows schematically an arrangement of an apparatus according to the invention.

DESCRIPTION OF A PARTICULAR EMBODIMENT

As shown in the FIGURE, the apparatus according to the invention includes a first station 1 in which four printing heads 1*a*, 1*b*, 1*c*, 1*d* are arranged. The printing heads 1*a*, 1*b*, 1*c*, 1*d* contain ink of different colors. For example, the printing head 1*d* includes black ink. The printing heads 1*a*, 1*b*, 1*c* contain ink of the colors cyan, magenta, and yellow.

Under the printing heads a foil 3 to be imprinted is arranged which foil is moved past the printing heads 1*a*, 1*b*, 1*c*, 1*d* in a transport direction indicated by an arrow 3'. In the transport direction 3' after the first station 1 an additional station 2 in the form of a fixing unit is arranged. For guiding the foil 3, the apparatus includes reversing rollers 4, 5, 6, 7. For transporting the foil 3 in the transport direction 3', the foil is pressed by an engagement roller 12*a* onto an electronically driven driveshaft 12. So far, the arrangement corresponds to a conventional apparatus for imprinting a material web.

By means of the printing heads 1*a*, 1*b*, 1*c*, 1*d* a partial image corresponding to the respective color is imprinted in each case onto the foil 3. Only after the respective area of the foil 3 has been moved past all the printing heads the particular color image is completed. The color image is then moved past the fixing unit 2 where it is fixed. In order to provide a complete image, the foil 3 therefore has to move over a distance marked by the arrows 3*a* and 3*b*. That is, upon shutdown of the printing apparatus, the foil 3 needs to be moved over that distance to complete the image generated partially by the first printing head 1*a*.

Since during this procedure, no new image is imprinted onto the foil 3, after completion of the last image, there is a bare, that is, unimprinted foil section between the two marks 3*a*, 3*b*. In order to provide, after resumption of the operation of the apparatus, for a continuous imprinting of the foil 3, the foil must be moved back in a direction opposite the transport direction 3' of the foil 3 by a corresponding distance. To perform this procedure, the apparatus includes a first buffer roller 5*a* around which the foil 3 extends in transport direction 3' of the foil ahead of the first re-direction roller. In this way, the foil forms a first U-shaped loop at the bottom of which the first buffer roller 5*a* is arranged.

The apparatus further includes a second buffer roller 4*a* around which the foil 3 extends in the transport direction 3' after the second reversing roller 4. In this way, the foil 3 forms a second U-shaped loop at the bottom end of which the second buffer roller 4*a* is arranged.

The buffer rollers 4*a*, 5*a* are arranged on a carriage 8 which is linearly movably supported on a guide track 8. In this way, the second buffer structure is connected to the first buffer structure in a positive control structure. By a displacement of the carriage 8, the depths of the loops can be changed. Since the buffer rollers are, by their arrangement on the same carrier 8, always moved in unison the depths of the loops change exactly proportionally in a reversed manner.

The reversing rollers 4, 5, 6, 7 and the buffer rollers 4*a*, 5*a* consist of metal. As a result, they have a low coefficient of friction which is advantageous for the alignment of the material web 3 transversely to the transport direction 3'. Furthermore, the reversing rollers 4, 5, 6, 7 and the buffer rollers 4*a*, 5*a* can be solidly arranged. As a result, a rigid setup is obtained in the area of the buffer arrangement which is also advantageous for obtaining a high accuracy of movement of the foil 3.

Since the buffer rollers 4*a*, 5*a* are arranged as compensating rollers at the bottom of a U-shaped loop they form, in combination with the respective reversing rollers, 4, 5 in each case a buffer structure. The greater the depth of a loop is the more foil is arranged in the respective buffer structure. By movement of the carriage 8 consequently, the content of the buffer structure can be changed. That is, by movement of the carriage content of one buffer structure can be transferred to the other buffer structure.

As a result, the foil 3 can be moved in a direction opposite its transport direction 3' by the length of the imprinted area between the marks 3*a*, 3*b* when the carriage 8 is moved in the FIGURE from the left to the right because, in this way, the content of the second buffer structure is decreased whereas the content of the second buffer structure is increased. In order to keep the buffer structures as small as possible which is advantageous with regard to the accuracy, the arrangement should preferably be so designed that the travel distance between the markings 3*a*, 3*b* is as small as possible.

For limiting the travel length of the carriage 8 inductive position sensors 9*a*, 9*b*, are provided. Instead of the position sensors 9*a*, 9*b*, the carriage may also be moved by means of a servomotor 8*b*. In this way, the movement of carriage 8 can also be controlled in a simple manner.

The third reversing roller 6 is in the form of a rotation sensor. In this way, the travel length of the foil 3 can be detected. In particular, the length of the foil 3 during the transfer of the foil 3 from one buffer structure to the other buffer structure can be monitored by means of the rotation sensor 6. Also in this way the displacement distance of the carriage can be controlled.

When the buffer storage rollers 4*a*, 5*a* and the reversing rollers are positioned next to each other, the buffer rollers 4*a*, 5*a*, are arranged below the redirection rollers 4, 5 at such a distance that their spacing corresponds to the thickness of the foil 3. As a result, the leg of the first loop which is disposed between the first buffer roller 5*a* and the first reversing roller 5 is disposed in the same plane as the leg of the second loop which is arranged between the second buffer roller 4*a* and the second reversing roller 4.

Taking into consideration that, with foils 3 of different thickness, the distance between the buffer rollers 4*a*, 5*a* from the reversing rollers 4, 5 needs to be changed, the distance between the buffer rollers 4*a*, 5*a* from the reversing rollers 4, 5 can be selected so that it corresponds to the thickness of the thickest foil which is to be imprinted by the apparatus. With this distance, it is then also possible to imprint thinner foils. Of course, the thicknesses of the foils to be imprinted by the apparatus should not differ excessively.

In the transport arrangement 3' of the foil 3, a clamping structure is arranged between the second buffer roller 4*a* and the drive of the foil 3 which comprises the drive shaft 12 and the drive roller 12*a*. The clamping arrangement comprises a roller 11*a* and a friction block 11*b*. With the clamping arrangement, any movement of the part of the foil 3 arranged in transport direction after the transport arrangement 3' of the foil 3 can be prevented during movement of the carriage 8.

Furthermore, a tensioning arrangement is arranged in transport direction 3' of the foil 3 ahead of the first compensation or storage roller 5*a* by which the foil 3 is maintained under tension. The tensioning arrangement consists of a pressure roller 10*a* and a DC generator 10. By means of the DC generator 10 a tensioning force can be applied to the foil 3.

Between the tensioning arrangement 10, 10*a* and the feed roll 13 a compensation roller 14 is arranged. With the compensation roller 14, the unwinding of the foil 3 from the feed roll 13 can be controlled in a known manner.

For increasing the buffer storage, the apparatus may include additional buffer rollers 4*a'*, 5*a'*, which are arranged on the carriage 8 above the buffer rollers 4*a*, 5*a*. By means of additional redirecting rollers 4', 5' two additional buffer structures can be formed which have the same capacity as the buffer structures 4, 5 described above. The elements of the additional buffer structure and the respective paths of the foils are shown in the FIGURE by dashed lines.

The invention claimed is:

1. A method comprising:

moving a material web in a transport direction during normal printing operation (i) from a material roll, (ii) through a first buffer, (iii) past a first station configured and arranged to apply a coloring agent to the material web, (iv) past a second station configured and arranged to fix the coloring agent on the material web, and (v) through a second buffer;

stopping the normal printing operation, after moving the material web in the transport direction;

moving the material web, after the stopping, in a direction opposite the transport direction by moving the first buffer and the second buffer in unison, while maintaining tension in the material web with a tensioning arrangement separate from the first buffer, the first station, the second station and the second buffer; and resuming the normal printing operation, after moving the material web in the direction opposite the transport direction.

2. The method of claim 1, wherein the first buffer comprises two buffer rollers, the second buffer comprises two buffer rollers, and moving the first buffer and the second buffer in unison comprises moving a common carriage on which the four buffer rollers of the first buffer and the second buffer are supported.

3. The method of claim 2, comprising using sensors to detect positions of the common carriage, and moving the common carriage with a servomotor.

4. The method of claim 2, wherein maintaining tension in the material web when moving the material web after the stopping comprises clamping the material web after the second buffer in the transport direction.

* * * * *